US007967061B2

(12) United States Patent
Gorbounov et al.

(10) Patent No.: US 7,967,061 B2
(45) Date of Patent: Jun. 28, 2011

(54) MINI-CHANNEL HEAT EXCHANGER HEADER

(75) Inventors: Mikhail B. Gorbounov, South Windsor, CT (US); Igor B. Vaisman, West Hartford, CT (US); Parmesh Verma, Manchester, CT (US); Gary D. Winch, Colchester, CT (US); Joseph J. Sangiovanni, West Suffield, CT (US)

(73) Assignee: Carrier Corporation, Farmington, CT (US)

( * ) Notice: Subject to any disclaimer, the term of this patent is extended or adjusted under 35 U.S.C. 154(b) by 999 days.

(21) Appl. No.: 11/794,432

(22) PCT Filed: Dec. 28, 2005

(86) PCT No.: PCT/US2005/047361
§ 371 (c)(1),
(2), (4) Date: Jun. 28, 2007

(87) PCT Pub. No.: WO2006/083447
PCT Pub. Date: Aug. 10, 2006

(65) Prior Publication Data

US 2008/0093062 A1 Apr. 24, 2008

Related U.S. Application Data

(60) Provisional application No. 60/649,426, filed on Feb. 2, 2005.

(51) Int. Cl.
*F28F 9/22* (2006.01)

(52) U.S. Cl. ..... 165/174

(58) Field of Classification Search ..... None
See application file for complete search history.

(56) References Cited

U.S. PATENT DOCUMENTS

| | | | |
|---|---|---|---|
| 5,743,329 | A | 4/1998 | Damsohn et al. |
| 2,297,633 | A | 9/1942 | Philipp |
| 2,591,109 | A | 4/1952 | Wade |
| 3,920,069 | A | 11/1975 | Mosier |
| 4,088,182 | A | 5/1978 | Basdekas et al. |
| 4,382,468 | A | 5/1983 | Hastwell |
| 4,497,363 | A | 2/1985 | Heronemus |
| 4,607,689 | A | 8/1986 | Mochida et al. |
| 4,724,904 | A | 2/1988 | Fletcher et al. |
| 5,320,165 | A | 6/1994 | Hughes |
| 5,341,870 | A | 8/1994 | Hughes et al. |
| 5,415,223 | A | 5/1995 | Reavis et al. |
| 5,517,757 | A | 5/1996 | Hayashi et al. |
| 5,632,329 | A | 5/1997 | Fay |
| 5,826,649 | A | 10/1998 | Chapp et al. |

(Continued)

FOREIGN PATENT DOCUMENTS

| | | |
|---|---|---|
| CN | 1611907 | 5/2005 |

(Continued)

*Primary Examiner* — Allen J Flanigan
(74) *Attorney, Agent, or Firm* — Marjama Muldoon Blasiak & Sullivan LLP

(57) ABSTRACT

A heat exchanger includes a plurality of multi-channel heat exchange tubes extending between spaced inlet and outlet headers. Each heat exchange tube has a plurality of flow channels defining discrete flow paths extending longitudinally in parallel relationship from its inlet end to its outlet end. The inlet header has a channel for receiving a two-phase fluid from a fluid circuit and a chamber for collecting the fluid. The chamber has an inlet in flow communication with the channel and an outlet in flow communication with the plurality of fluid flow paths of the heat exchange tubes. The channel defines a relatively high turbulence flow passage that induces uniform mixing of the liquid phase refrigerant and the vapor phase fluid and reduces potential stratification of the vapor phase and the liquid phase within the fluid passing through the header.

21 Claims, 6 Drawing Sheets

U.S. PATENT DOCUMENTS

| | | | |
|---|---|---|---|
| 5,934,367 | A | 8/1999 | Shimmura et al. |
| 5,941,303 | A | 8/1999 | Gowan et al. |
| 5,967,228 | A | 10/1999 | Bergman et al. |
| 5,971,065 | A | 10/1999 | Bertilson et al. |
| 6,340,055 | B1 | 1/2002 | Yamauchi et al. |
| 6,564,863 | B1 | 5/2003 | Martins |
| 6,688,137 | B1 | 2/2004 | Gupte |
| 6,688,138 | B2 | 2/2004 | DiFlora |
| 2001/0004935 | A1 | 6/2001 | Sanada et al. |
| 2003/0116308 | A1 | 6/2003 | Watanabe et al. |
| 2003/0155109 | A1 | 8/2003 | Kawakubo et al. |

FOREIGN PATENT DOCUMENTS

| | | |
|---|---|---|
| EP | 0228330 | 7/1987 |
| FR | 1258044 | 4/1961 |
| JP | 2217764 | 8/1990 |
| JP | 4080575 | 3/1992 |
| JP | 6241682 | 9/1994 |
| JP | 7301472 | 11/1995 |
| JP | 8233409 | 9/1996 |
| JP | 11351706 | 12/1999 |
| JP | 2002022313 | 1/2002 |
| WO | WO-0242707 | 5/2002 |

MINI-CHANNEL HEAT EXCHANGER HEADER

CROSS-REFERENCE TO RELATED APPLICATION

Reference is made to and this application claims priority from and the benefit of U.S. Provisional Application Ser. No. 60/649,426, filed Feb. 2, 2005, and entitled MINI-CHANNEL HEAT EXCHANGER HEADER, which application is incorporated herein in its entirety by reference.

FIELD OF THE INVENTION

This invention relates generally to heat exchangers having a plurality of parallel tubes extending between a first header and a second header and, more particularly, to improving fluid flow distribution amongst the tubes receiving fluid flow from the header of a heat exchanger, for example a heat exchanger in a refrigerant vapor compression system.

BACKGROUND OF THE INVENTION

Refrigerant vapor compression systems are well known in the art. Air conditioners and heat pumps employing refrigerant vapor compression cycles are commonly used for cooling or cooling/heating air supplied to a climate controlled comfort zone within a residence, office building, hospital, school, restaurant or other facility. Refrigerant vapor compression systems are also commonly used for cooling air, or other secondary media such as water or glycol solution, to provide a refrigerated environment for food items and beverage products within, for instance, display cases in supermarkets, convenience stores, groceries, cafeterias, restaurants and other food service establishments.

Conventionally, these refrigerant vapor compression systems include a compressor, a condenser, an expansion device, and an evaporator connected in refrigerant flow communication. The aforementioned basic refrigerant system components are interconnected by refrigerant lines in a closed refrigerant circuit and arranged in accord with the vapor compression cycle employed. An expansion device, commonly an expansion valve or a fixed-bore metering device, such as an orifice or a capillary tube, is disposed in the refrigerant line at a location in the refrigerant circuit upstream with respect to refrigerant flow of the evaporator and downstream of the condenser. The expansion device operates to expand the liquid refrigerant passing through the refrigerant line running from the condenser to the evaporator to a lower pressure and temperature. In doing so, a portion of the liquid refrigerant traversing the expansion device expands to vapor. As a result, in conventional refrigerant vapor compression systems of this type, the refrigerant flow entering the evaporator constitutes a two-phase mixture. The particular percentages of liquid refrigerant and vapor refrigerant depend upon the particular expansion device employed and the refrigerant in use, for example R12, R22, R134a, R404A, R410A, R407C, R717, R744 or other compressible fluid.

In some refrigerant vapor compression systems, the evaporator is a parallel tube heat exchanger. Such heat exchangers have a plurality of parallel refrigerant flow paths therethrough provided by a plurality of tubes extending in parallel relationship between an inlet header, or inlet manifold, and an outlet header, or outlet manifold. The inlet header receives the refrigerant flow from the refrigerant circuit and distributes the refrigerant flow amongst the plurality of flow paths through the heat exchanger. The outlet header serves to collect the refrigerant flow as it leaves the respective flow paths and to direct the collected flow back to the refrigerant line for return to the compressor in a single pass heat exchanger or to an additional bank of heat exchange tubes in a multi-pass heat exchanger. In the latter case, the outlet header is an intermediate manifold or a manifold chamber and serves as an inlet header to the next downstream bank of tubes.

Historically, parallel tube heat exchangers used in such refrigerant vapor compression systems have used round tubes, typically having a diameter of ½ inch, ⅜ inch or 7 millimeters. More recently, flat, typically rectangular or oval in cross-section, multi-channel tubes are being used in heat exchangers for refrigerant vapor compression systems. Each multi-channel tube typically has a plurality of flow channels extending longitudinally in parallel relationship the length of the tube, each channel providing a small flow area refrigerant flow path. Thus, a heat exchanger with multi-channel tubes extending in parallel relationship between the inlet and outlet headers of the heat exchanger will have a relatively large number of small flow area refrigerant flow paths extending between the two headers. In contrast, a parallel tube heat exchanger with conventional round tubes will have a relatively small number of large flow area flow paths extending between the inlet and outlet headers.

Non-uniform distribution, also referred to as maldistibution, of two-phase refrigerant flow is common problem in parallel tube heat exchangers which adversely impacts heat exchanger efficiency. Two-phase maldistribution problems are often caused by the difference in density of the vapor phase refrigerant and the liquid phase refrigerant present in the inlet header due to the expansion of the refrigerant as it traversed the upstream expansion device.

One solution to control refrigeration flow distribution through parallel tubes in an evaporative heat exchanger is disclosed in U.S. Pat. No. 6,502,413, Repice et al. In the refrigerant vapor compression system disclosed therein, the high pressure liquid refrigerant from the condenser is partially expanded in a conventional in-line expansion value upstream of the evaporative heat exchanger inlet header to a lower pressure, liquid refrigerant. A restriction, such as a simple narrowing in the tube or an internal orifice plate disposed within the tube, is provided in each tube connected to the inlet header downstream of the tube inlet to complete expansion to a low pressure, liquid/vapor refrigerant mixture after entering the tube.

Another solution to control refrigeration flow distribution through parallel tubes in an evaporative heat exchanger is disclosed in Japanese Patent No. JP4080575, Kanzaki et al. In the refrigerant vapor compression system disclosed therein, the high pressure liquid refrigerant from the condenser is also partially expanded in a conventional in-line expansion value to a lower pressure, liquid refrigerant upstream of a distribution chamber of the heat exchanger. A plate having a plurality of orifices therein extends across the chamber. The lower pressure liquid refrigerant expands as it passes through the orifices to a low pressure liquid/vapor mixture downstream of the plate and upstream of the inlets to the respective tubes opening to the chamber.

Japanese Patent No. JP2002022313, Yasushi, discloses a parallel tube heat exchanger wherein refrigerant is supplied to the header through an inlet tube that extends along the axis of the header to terminate short of the end the header whereby the two phase refrigerant flow does not separate as it passes from the inlet tube into an annular channel between the outer surface of the inlet tube and the inside surface of the header. The two phase refrigerant flow thence passes into each of the tubes opening to the annular channel.

Obtaining uniform refrigerant flow distribution amongst the relatively large number of small flow area refrigerant flow paths is even more difficult than it is in conventional round tube heat exchangers and can significantly reduce heat exchanger efficiency as well as cause serious reliability problems due to compressor flooding. Two-phase maldistribution problems may be exacerbated in inlet headers associated with conventional flat tube heat exchangers due to the lower fluid flow velocities attendant to the larger dimensions of such headers. At lower fluid flow velocities, the vapor phase fluid more readily separates from the liquid phase fluid. Thus, rather than being a relatively uniform mixture of vapor phase and liquid phase fluid, the flow within the inlet header will be stratified to a greater degree with a vapor phase component separated from the liquid phase component. As a consequence, the fluid mixture will undesirably be non-uniformly distributed amongst the various tubes, with each tube receiving differing mixtures of vapor phase and liquid phase fluid.

In U.S. Pat. No. 6,688,138, DiFlora discloses a parallel, flat tube heat exchanger having an inlet header formed of an elongated outer cylinder and an elongated inner cylinder disposed eccentrically within the outer cylinder thereby defining a fluid chamber between the inner and outer cylinders. The inlet end of each of the flat, rectangular heat exchange tubes extend through the wall of the outer cylinder to open into the fluid chamber defined between the inner and outer cylinders.

Japanese Patent No. 6241682, Massaki et al., discloses a parallel flow tube heat exchanger for a heat pump wherein the inlet end of each multi-channel tube connecting to the inlet header is crushed to form a partial throttle restriction in each tube just downstream of the tube inlet. Japanese Patent No. JP8233409, Hiroaki et al., discloses a parallel flow tube heat exchanger wherein a plurality of flat, multi-channel tubes connect between a pair of headers, each of which has an interior which decreases in flow area in the direction of refrigerant flow as a means to uniformly distribute refrigerant to the respective tubes.

SUMMARY OF THE INVENTION

It is a general object of the invention to reduce maldistribution of a two-phase fluid flow in a heat exchanger having a plurality of multi-channel tubes extending between a first header and a second header.

It is an object of one aspect of the invention to distribute two-phase fluid flow in a relatively uniform manner in a heat exchanger having a plurality of multi-channel tubes extending between a first header and a second header.

A heat exchanger is provided having at least one heat exchange tube defining a plurality of discrete fluid flow paths therethrough and a header having a chamber for collecting a fluid and a channel for receiving a two-phase fluid from a fluid circuit. The chamber has an inlet in flow communication with the channel and an outlet in flow communication with an inlet opening to the plurality of fluid flow paths of the heat exchange tube. The channel defines a relatively high turbulence flow passage that induces uniform mixing of the liquid phase refrigerant and the vapor phase fluid and reduces potential stratification of the vapor phase and the liquid phase within the fluid passing through the header. Among other applications, the heat exchanger of the invention may be employed in refrigerant vapor compression systems of various designs, including, without limitation, heat pump cycles, economized cycles and commercial refrigeration cycles.

In an embodiment, the heat exchanger includes a plurality of heat exchange tubes having a plurality of flow paths extending longitudinally in parallel relationship from the inlet end to the outlet end thereof, and an inlet header defining a longitudinally extending chamber. The inlet header has a plurality of longitudinally spaced slots opening to the header chamber through a wall of the inlet header. Each slot adapted to receive the inlet end of a respective heat exchange tube. A longitudinally extending insert is disposed within the header chamber. The insert header defines a channel extending longitudinally within the header for receiving a fluid from a fluid circuit and a chamber extending longitudinally within the header, the chamber being in flow communication with the plurality of flow paths of the plurality of heat exchange tubes and in fluid flow communication with the channel. The channel defines a relatively high turbulence flow passage.

In an embodiment, the heat exchanger includes an inlet header defining a longitudinally extending chamber having an open mouth and a plurality of heat exchange tubes disposed in longitudinally spaced relationship with their respective the inlet ends extending into the open mouth of the header chamber. Each heat exchange tube defines a plurality of flow paths extending longitudinally in parallel relationship from the inlet end to the outlet end of the tube. A channel extends longitudinally within the header for receiving a fluid from a fluid circuit. The header chamber is in flow communication with the channel. A plurality of block inserts are arranged with an insert disposed within the header chamber between each pair of neighboring heat exchange tubes to fill volume within the header chamber between each pair of neighboring heat exchange tubes.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
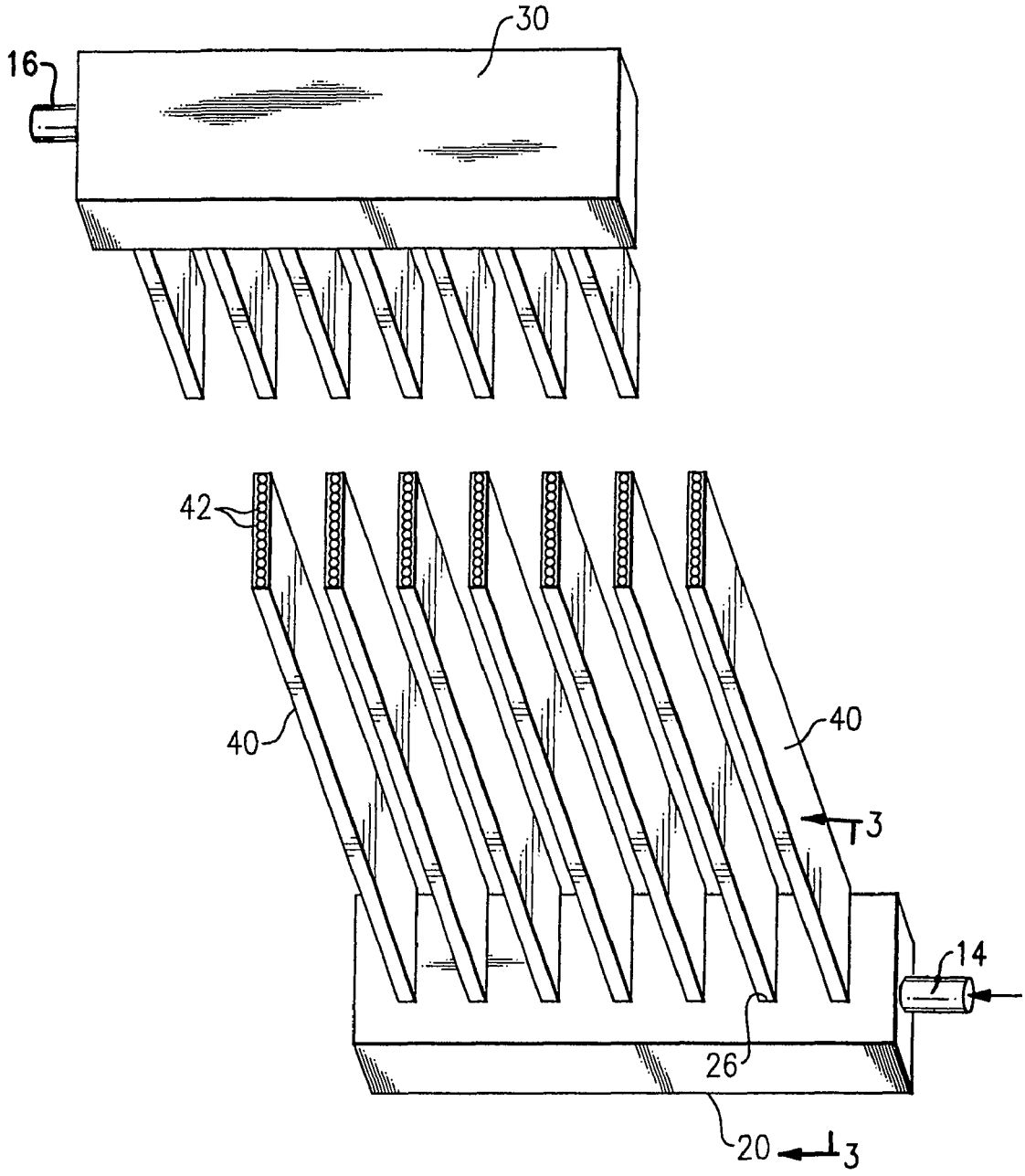
FIG. 1 is a perspective view of an embodiment of a heat exchanger in accordance with the invention.

The heat exchanger 10 of the invention will be described in general herein with reference to the illustrative single pass, parallel tube embodiment of a multi-channel tube heat exchanger as depicted in FIG. 1. In the illustrative embodiment of the heat exchanger 10 depicted in FIG. 1, the heat exchange tubes 40 are shown arranged in parallel relationship extending generally vertically between a generally horizontally extending inlet header 20 and a generally horizontally extending outlet header 30. The plurality of longitudinally extending multi-channel heat exchanger tubes 40 provide a plurality of fluid flow paths between the inlet header 20 and the outlet header 30. Each heat exchange tube 40 has an inlet at its inlet end in fluid flow communication to the inlet header 20 and an outlet at its other end in fluid flow communication to the outlet header 30.

However, the depicted embodiment is illustrative and not limiting of the invention. It is to be understood that the invention described herein may be practiced on various other configurations of the heat exchanger 10. For example, the heat exchange tubes may be arranged in parallel relationship extending generally horizontally between a generally vertically extending inlet header and a generally vertically extending outlet header. As a further example, the heat exchanger could have a toroidal inlet header and a toroidal outlet header of a different diameter with the heat exchange tubes extend either somewhat radially inwardly or somewhat radially outwardly between the toroidal headers. In such an arrangement, although not physically parallel to each other, the tubes are in a "parallel flow" arrangement in that those tubes extend between common inlet and outlet headers.

Each multi-channel heat exchange tube 40 has a plurality of parallel flow channels 42 extending longitudinally, i.e. along the axis of the tube, the length of the tube thereby providing multiple, independent, parallel flow paths between the inlet and the outlet of the tube. Each multi-channel heat exchange tube 40 is a "flat" tube of flattened rectangular, or oval, cross-section defining an interior which is subdivided to form a side-by-side array of independent flow channels 42. The flat, multi-channel tubes 40 may, for example, have a width of fifty millimeters or less, typically twelve to twenty-five millimeters, and a depth of about two millimeters or less, as compared to conventional prior art round tubes having a diameter of either ½ inch, ⅜ inch or 7 mm. The tubes 40 will typically have about ten to twenty flow channels 42, but may have a greater or a lesser multiplicity of channels, as desired. Generally, each flow channel 42 will have a hydraulic diameter, defined as four times the flow area divided by the perimeter, in the range from about 200 microns to about 3 millimeters, and commonly about 1 millimeter. Although depicted as having a circular cross-section in the drawings, the channels 42 may have a rectangular, triangular or trapezoidal cross-section or any other desired non-circular cross-section.

In the embodiment of the heat exchanger 10 depicted in FIGS. 2-5, the headers 20 and 30 comprise longitudinally elongated, hollow, closed end shell 22 having a rectangular shaped cross-section. An insert 50 is disposed within the interior of the shell 22 of the inlet header 20 so as to extend longitudinally between the closed ends of the shell. The insert 50 includes a trough 52 extending longitudinally the length of the inlet header 20 and having an open mouth opening upwardly. The trough 52 includes a longitudinally extending channel 54 at the base of the trough and a longitudinally extending chamber 55 that extends generally upwardly and outwardly from the channel 54 to the open mouth of the insert 24. The channel 54 receives fluid entering the header 20 from the inlet line 14.

Figure 2:
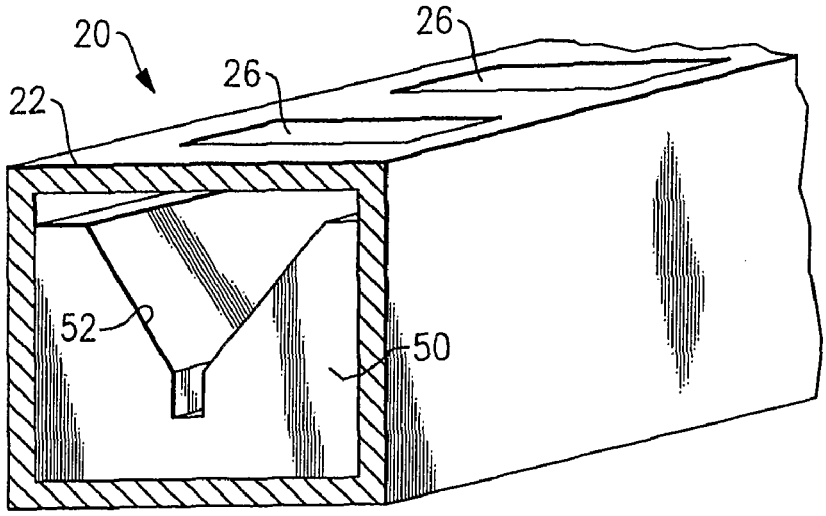
FIG. 2 is a perspective view, partly sectioned, of an embodiment of the inlet header of FIG. 1.
Figure 3:
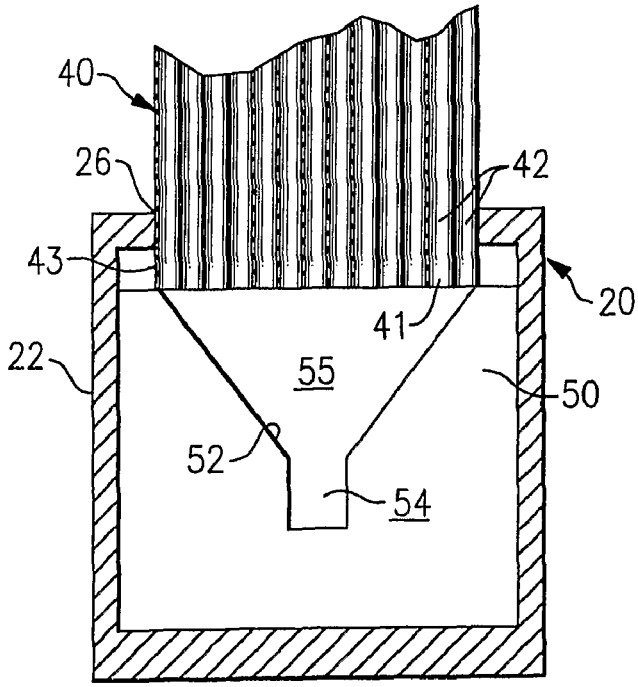
FIG. 3 is a sectioned elevation view taken along line 3-3 of FIG. 1.
Figure 4:
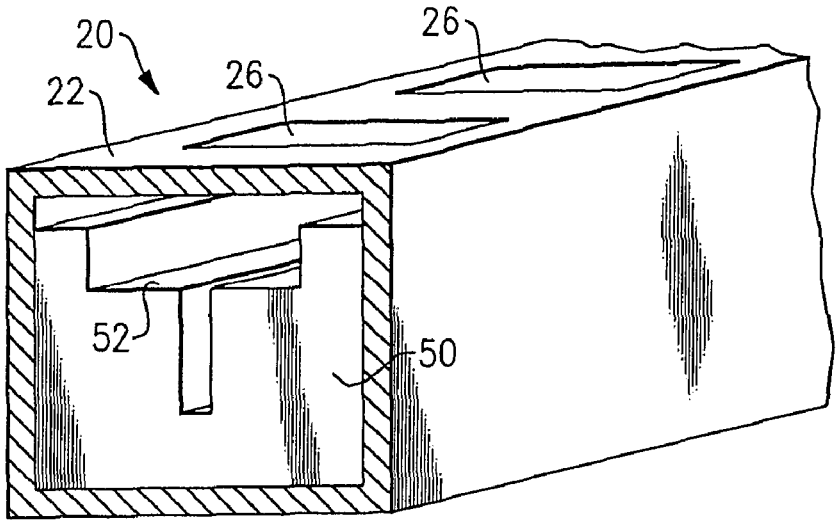
FIG. 4 is a perspective view, partly sectioned, of another embodiment of the inlet header of FIG. 1.
Figure 5:
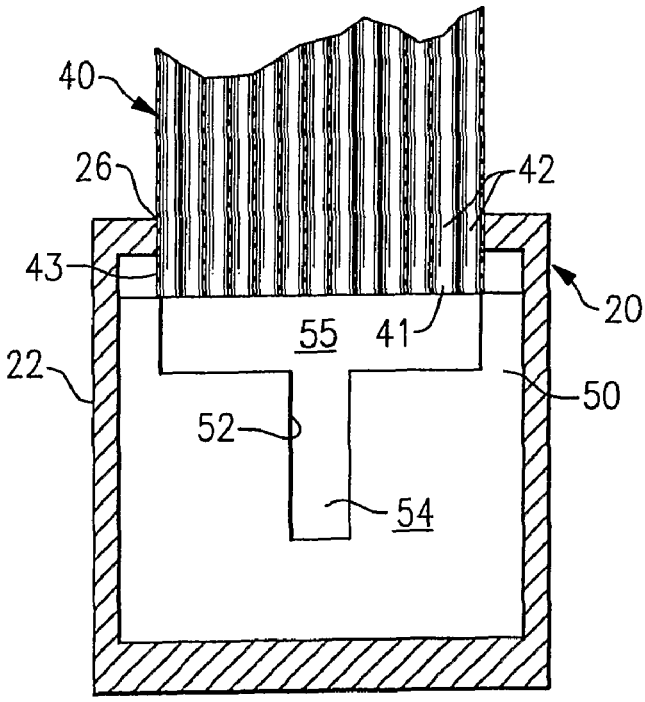
FIG. 5 is a sectioned elevation view taken along line 3-3 of FIG. 1 with the inlet header of FIG. 4.

Each of the plurality of heat exchange tubes 40 of the heat exchanger 10 has its inlet end 43 inserted into a slot 26 in the wall 22 of the inlet header 20. So inserted, the flow channels 42 of the heat exchange tubes 40 are open to the mouth of the trough 52 of the insert 50 and thereby in fluid flow communication with the chamber 55. The chamber 55 may be generally V-shaped as depicted in FIGS. 2 and 3 with the bottom of the V-shaped chamber open along its length to the channel 54, or generally T-shaped as depicted in FIGS. 4 and 5 with the channel 54 being commensurate with the lower part of the upright portion of the T-shaped chamber. However, those skilled in the art will recognize that the chamber 55 may be semi-circular in shape or otherwise contoured to diverge generally upwardly and outwardly from the channel 54 toward mouth of the trough 52 to facilitate distribution of the fluid to the flow channels 42 of the heat exchange tubes 40.

Figure 6:
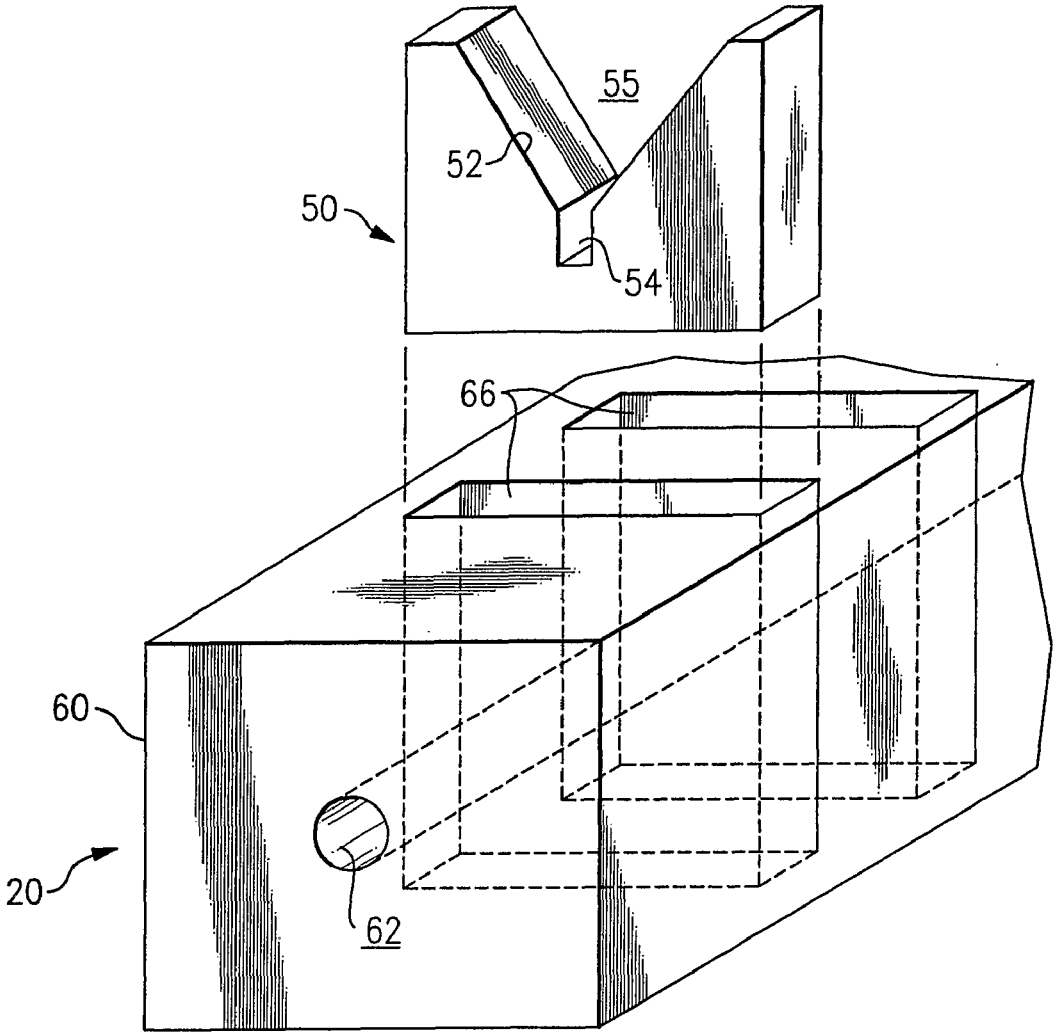
FIG. 6 is an exploded perspective view of another embodiment of the heat exchanger of the invention.
Figure 7:
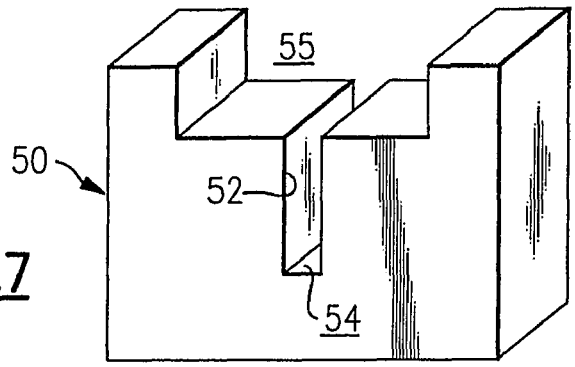
FIG. 7 is a perspective view of another embodiment of the insert of FIG. 6.
Figure 8:
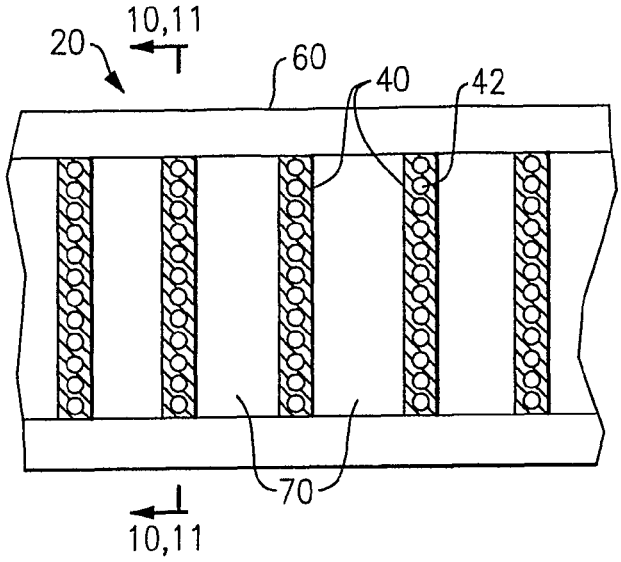
FIG. 8 is a plan view, partly sectioned, of another embodiment of the heat exchanger of the invention.
Figure 9:
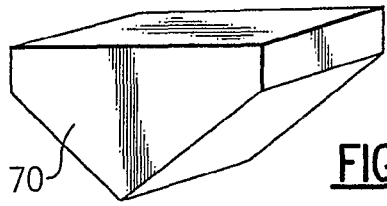
FIG. 9 is a perspective of the block insert of FIG. 8.

Referring now to FIGS. 6 and 7, in the embodiment depicted therein, the header 20 comprises a longitudinally elongated, solid body 60 having a rectangular shaped cross-section and having a bore 62 extending longitudinally along or generally parallel to the axis of the header 20. The bore 62 receives fluid from the inlet line 14 for distribution to the channels 42 of the plurality of heat exchange tubes 40. A plurality of longitudinally spaced, open slots 66 are formed in the block 60 to open through the top surface of the header 20. Each slot 66 is adapted to receive an insert 50. Each of the inserts 50 includes a trough 52 having a channel 54 at the base of the through and a chamber 55 that extends upwardly and outwardly from the channel 54 to an upwardly opening mouth adapted to receive the inlet end 43 of a respective one of the heat exchange tubes 40. The channel 54 opens in fluid flow communication to the bore 62 to receive fluid therefrom. The chamber 55 may be generally V-shaped as depicted in FIG. 6 with the bottom of the V-shaped chamber open along its length to the channel 54, or generally T-shaped as depicted in FIG. 7 with the channel 54 being commensurate with the lower part of the upright portion of the T-shaped chamber. However, those skilled in the art will recognize that the chamber 55 may be semi-circular in shape or otherwise contoured to diverge generally upwardly and outwardly from the channel 55 to facilitate distribution of the fluid to the flow channels 42 of the heat exchange tubes 40. In the embodiments depicted in FIGS. 6 and 7, the inserts 50 receive the inlet end 43 of a respective one of the heat exchange tubes 40 in a manner similarly as depicted in FIGS. 3 and 5.

Figure 10:
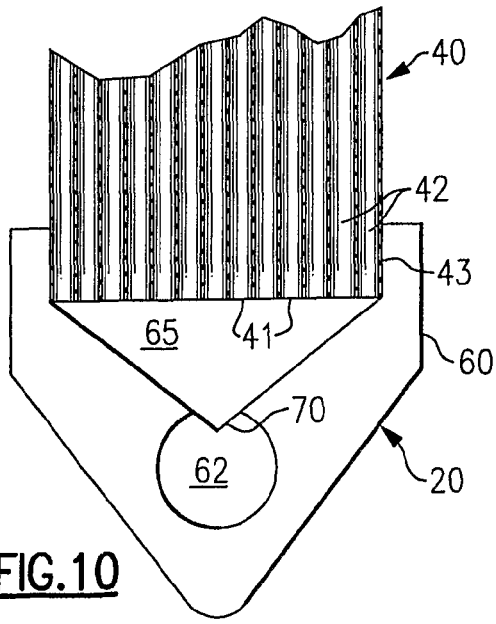
FIG. 10 is a sectioned elevation view taken along line 10-10 of FIG. 9 showing one embodiment of the inlet header.
Figure 11:
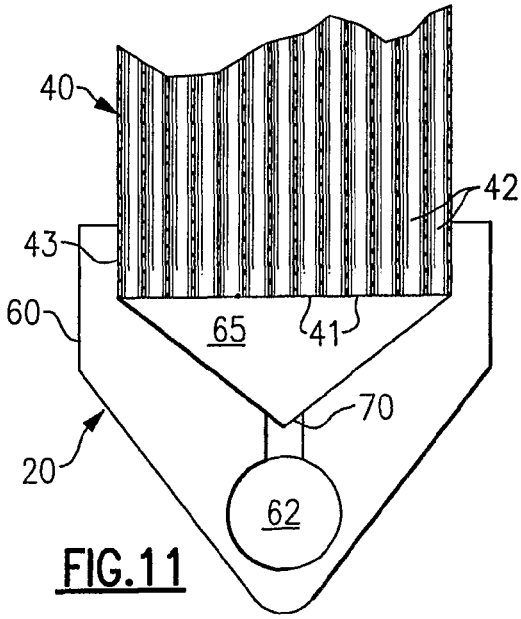
FIG. 11 is a sectioned elevation view taken along line 11-11 of FIG. 9 showing one embodiment of the inlet header.

Referring now to FIGS. 8-11, in the embodiment depicted therein, the inlet header 20 comprises a longitudinally elongated extruded body 60 having a bore 62 in a lower region of the extruded body extending longitudinally parallel to the axis of the header 20 and an open chamber 65 disposed above and in fluid flow communication with the bore 62. The chamber 65 extends longitudinally the length of the extended body 60 and is adapted to receive the inlet ends 43 of the respective heat exchange tubes 40. The heat exchange tubes 40 are disposed at longitudinally spaced intervals along the length of the extruded body 60. The bore 62 receives fluid from the inlet line 14 for distribution to the channels 42 of the plurality of heat exchange tubes 40. With the heat exchange tubes 40 disposed at longitudinally spaced intervals, gaps are present in the chamber 55 between the inlet ends 43 of neighboring heat exchange tubes 40 and laterally outwardly of the end most heat exchange tube at each end of the header. To fill these gaps, a solid insert 70 is inserted into each of the gaps. Therefore, the chamber 65 is subdivided into a plurality of subchambers each of which is in fluid communication at its lower end with the bore 62 and at its mouth is in fluid communication with the inlets 41 to the flow channels 42 of a respective one of the plurality of heat exchange tubes 40. Fluid entering the header 60 from the line 14 passes into and through the bore 62 to enter each of the respective subchambers of chamber 65 to be distributed to the flow channels 42 of the plurality of heat exchange tubes 40 opening to the subchambers. The chamber 65 may be generally V-shaped, as depicted in FIGS. 10 and 11, or may be semi-circular in shape or otherwise contoured to diverge generally upwardly and outwardly from the bottom of the chamber 65 to the mouth thereof to facilitate distribution of the fluid to the flow channels 42 of the heat exchange tubes 40. In the embodiment depicted in FIG. 10, the chamber 65 opens directly to the bore 62 along its entire length. In the embodiment depicted in FIG. 11, the chamber 65 does not open directly to the bore 62, but rather a plurality of orifice holes 66 are provided at longitudinally spaced intervals along the length of the bore 62 in alignment with the respective inlet ends 43 of the heat exchange tubes 40. Each orifice hole 66 extends vertically upwardly from the bore 62 to open into a respective subchamber of the chamber 65 formed between a pair of neighboring inserts 70. Each orifice hole 66 may be sized to have a sufficiently small cross-sectional flow area so as to function as an expansion orifice for expanding, at least partially, the fluid passing therethrough. Thus, in the FIG. 11 embodiment, the inlet header 20 serves as both a distribution header and an expansion header.

Figure 12:
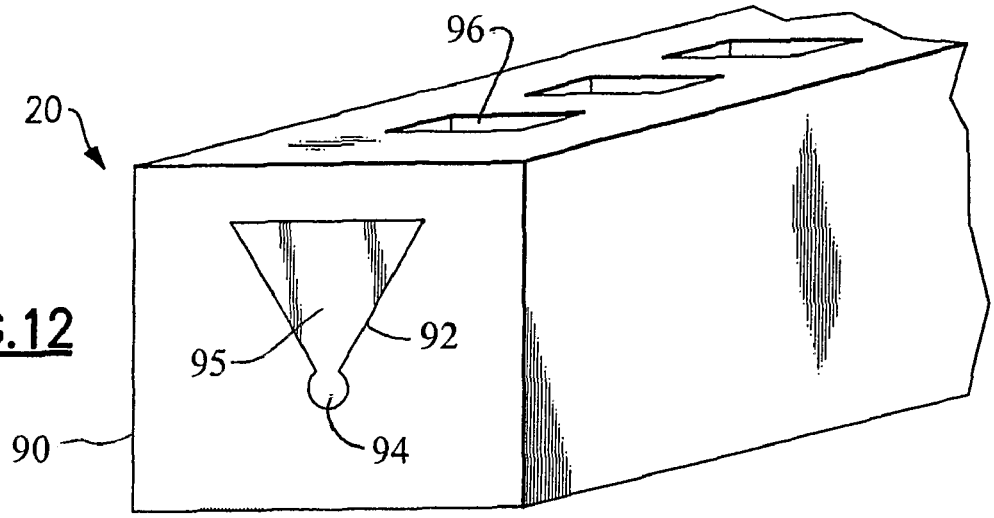
FIG. 12 is a perspective view, partly sectioned, of a further embodiment of the inlet header of the heat exchanger of the invention.
Figure 13:
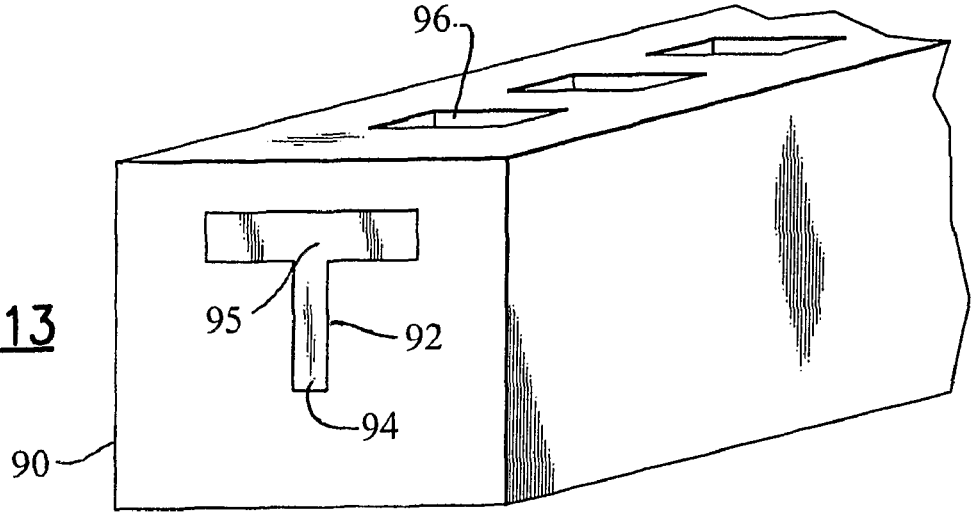
FIG. 13 is a perspective view, partly sectioned, of an additional embodiment of the inlet header of the heat exchanger of the invention.

Referring now to FIGS. 12 and 13, the inlet header 20 comprises an extruded block 90 with a passage 92 extending longitudinally therethrough. The channel 92 has a longitudinally extending channel 94 at its base, which receives fluid entering the header 20 from line 14, and a longitudinally extending chamber 95 that extends upwardly and outwardly from the channel 94. A plurality of slots 96 are punched at longitudinally spaced intervals in the top wall of the block 90 to open into and in fluid communication with the passage 92. Each of the slots 96 is adapted to receive the inlet end 43 of a respective heat exchange tube 40 whereby the inlets 41 of the flow channels 42 of the heat exchange tube will be open in flow communication with the chamber 95 of the passage 92. The chamber 95 may be generally V-shaped as depicted in FIG. 12 with the bottom of the V-shaped chamber open along its length to the channel 94, or generally T-shaped as depicted in FIG. 1 with the channel 94 being commensurate with the lower part of the upright portion of the T-shaped chamber. However, those skilled in the art will recognize that the chamber 95 may be semi-circular in shape or otherwise contoured to diverge generally upwardly and outwardly from the channel 94 to facilitate distribution of the fluid to the flow channels 42 of the heat exchange tubes 40.

Figure 14:
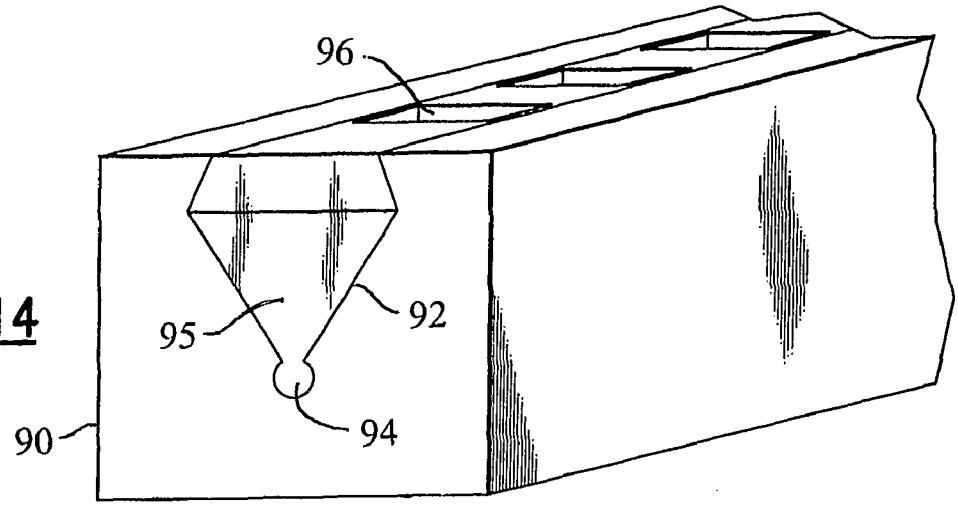
FIG. 14 is a perspective view, partly sectioned, of another embodiment of the inlet header of the heat exchanger of the invention.

In the embodiment depicted in FIG. 14, the inlet header 20 again comprises an extruded block 90 with a passage 92 extending longitudinally therethrough. The passage 92 has a longitudinally extending channel 94 at its base, which receives fluid entering the header 20 from line 14, and a longitudinally extending chamber 95 that extends upwardly and outwardly from the channel 94. In this embodiment, the passage 92 is open through the top wall of the extruded block 90 and is adapted to receive a cover plate 98 that has a plurality of slots 96 punched therethrough at longitudinally spaced intervals along the length thereof. Each of the slots 96 opens into the chamber 95 and is adapted to receive the inlet end 43 of a respective heat exchange tube 40 whereby the inlets 41 of the flow channels 42 of the heat exchange tube will be open in flow communication with the chamber 95 of the passage 92.

The header of the invention is characterized by the relatively small fluid volume and cross-sectional flow area of the passages that the fluid entering the header 20 from line 14 must traverse to be distributed to the flow channels 42 of the respective heat exchange tubes 40. Consequently, the fluid flowing through the header of the invention will have a higher velocity and will be significantly more turbulent. The increased turbulence will induce more thorough mixing within the fluid flowing through the header and result in a more uniform distribution of fluid flow amongst the heat exchange tubes opening to the header. This is particularly true for mixed liquid/vapor flow, such as a refrigerant liquid/vapor mixture, which is the typical state of flow delivered into the inlet header of an evaporator heat exchanger in a vapor compression system operating in a refrigeration, air conditioning or heat pump cycle. The channels 54, 62, 94 define relatively high turbulence flow passages that induce uniform mixing of the liquid phase refrigerant and the vapor phase refrigerant and reduce potential stratification of the vapor phase and the liquid phase within the refrigerant passing through the header. The heat exchanger of the invention may be employed in refrigerant vapor compression systems of various designs, including, without limitation, heat pump cycles, economized cycles and commercial refrigeration cycles.

The depicted embodiment of a single-pass heat exchanger 10 is illustrative and not limiting of the invention. It is to be understood that the invention described herein may be practiced on various other configurations of the heat exchanger 10. For example, the heat exchanger of the invention may also be arranged in various multi-pass embodiments as an evaporator, as a condenser, or as a condenser/evaporator. The cross-section of the inlet header of the heat exchanger is not limited to the particular cross-sections illustrated in the drawings, but rather may be of any suitable cross-sectional shape, including but not limited to semi-circular, semi-elliptical, or hexagonal.

While the present invention has been particularly shown and described with reference to the embodiments illustrated in the drawing, it will be understood by one skilled in the art that various changes in detail may be effected therein without departing from the spirit and scope of the invention as defined by the claims.

We claim:

1. A heat exchanger comprising: at least one heat exchange tube defining a plurality of discrete fluid flow paths therethrough and having an inlet opening to said plurality of fluid flow paths; and a header having a chamber for distributing a fluid and a channel for receiving a fluid from a fluid circuit, said chamber having an inlet in flow communication with said channel and an outlet in flow communication with the inlet opening to said plurality of fluid flow paths of said at least one heat exchange tube, said channel defining a relatively high turbulence flow passage, said chamber being connected in fluid flow communication with said channel by at least one orifice hole.

2. A heat exchanger as recited in claim 1 wherein said chamber has a generally T-shaped cross-section.

3. A heat exchanger as recited in claim 1 wherein said chamber has a generally V-shaped cross-section.

4. A heat exchanger as recited in claim 3 wherein said channel has a generally circular cross-section.

5. A heat exchanger as recited in claim 4 wherein said generally V-shaped chamber is directly open in fluid flow communication with said channel.

6. A heat exchanger as recited in claim 1 wherein said chamber has a contoured cross-section diverging generally outwardly from said channel toward the outlet of said chamber.

7. A heat exchanger as recited in claim 6 wherein said chamber is directly open in fluid flow communication with said channel.

8. A heat exchanger as recited in claim 6 wherein said channel has a generally circular cross-section.

9. A heat exchanger as recited in claim 1 wherein said header is an extruded body.

10. A heat exchanger comprising: a plurality of heat exchange tubes having an inlet end and an outlet end, each of said plurality of heat exchange tubes having a plurality of flow paths extending longitudinally in parallel relationship from the inlet end to the outlet end thereof, an inlet header comprised of a longitudinally elongated, hollow shell and an insert disposed within the interior of the shell, said shell and insert defining a longitudinally extending chamber extending a majority of the longitude of the inlet header, said inlet header having a plurality of longitudinally spaced slots opening to said header chamber through a wall of said inlet header, each slot adapted to receive the inlet end of a respective heat exchange tube;

a longitudinally extending insert disposed within said chamber of said inlet header, said insert defining a channel extending longitudinally within said header for receiving a fluid from a fluid circuit and a chamber extending longitudinally within said header, said chamber of said insert being in flow communication with the plurality of flow paths of said plurality of heat exchange tubes and being in fluid flow communication with said channel, said channel defining a relatively high turbulence flow passage, said chamber being connected in fluid flow communication with said channel by at least one orifice hole.

11. A heat exchanger as recited in claim 10 wherein said chamber has a generally T-shaped cross-section.

12. A heat exchanger as recited in claim 10 wherein said chamber has a generally V-shaped cross-section.

13. A heat exchanger as recited in claim 12 wherein said generally V-shaped chamber is directly open in fluid flow communication with said channel.

14. A heat exchanger as recited in claim 10 wherein said chamber has a contoured cross-section diverging generally outwardly from said channel toward said wall of said inlet header having the plurality of slots therein.

15. A heat exchanger as recited in claim 14 wherein said chamber is directly open in fluid flow communication with said channel.

16. A heat exchanger comprising: an inlet header defining a longitudinally extending chamber having an open mouth and a channel extending longitudinally within said header for receiving a fluid from a fluid circuit, said header chamber in flow communication with said channel;

a plurality of heat exchange tubes disposed in longitudinally spaced relationship, each of said plurality of heat exchange tubes having an inlet end, an outlet end, and a plurality of flow paths extending longitudinally in parallel relationship from the inlet end to the outlet end, the inlet ends of said plurality of heat exchange tubes extending into the open mouth of said header chamber; and a plurality of block inserts arranged with an insert disposed within said header chamber between each pair of neighboring heat exchange tubes of said plurality of heat exchange tubes, said block inserts filling volume within the header chamber between each pair of neighboring heat exchange tubes.

17. A heat exchanger as recited in claim 16 wherein said channel defines a relatively high turbulence flow passage.

18. A heat exchanger as recited in claim 17 wherein said chamber has a contoured cross-section diverging generally outwardly from said channel toward said wall of said inlet header having the plurality of slots therein.

19. A heat exchanger as recited in claim 18 wherein said chamber is directly open in fluid flow communication with said channel.

20. A heat exchanger as recited in claim 18 wherein said chamber is connected in fluid flow communication with said channel by at least one orifice hole.

21. A heat exchanger as recited in claim 16 wherein said header is an extruded body.

* * * * *